United States Patent [19]

Foust

[11] 4,404,716

[45] Sep. 20, 1983

[54] COFFIN BED ADJUSTING APPARATUS

[76] Inventor: Robert K. Foust, 301 May Kay La., Connersville, Ind. 47331

[21] Appl. No.: 405,993

[22] Filed: Aug. 8, 1982

[51] Int. Cl.[3] ..... A61G 17/00

[52] U.S. Cl. ..... 27/12

[58] Field of Search ..... 27/12, 1, 2, 13, 27–32; 248/124, 125, 144, 145; 5/282 R, 68

[56] References Cited

U.S. PATENT DOCUMENTS

| | | | |
|---|---|---|---|
| 2,670,517 | 3/1954 | Hillenbrand et al. | 27/12 |
| 2,839,814 | 6/1958 | Harter | 27/12 |
| 2,888,732 | 6/1959 | Nelson | 27/12 |

*Primary Examiner*—John D. Yasko

*Attorney, Agent, or Firm*—Woodard, Weikart, Emhardt & Naughton

[57] ABSTRACT

A coffin bed adjusting apparatus for providing both elevation and tilt adjustments to a coffin bed in a burial casket. The bed frame is connected to a bed support member which is pivotally mounted to an elevating support member. The elevating support member is threadedly mounted on a threaded shaft, the rotation of which adjusts the vertical height of the bed. A rack is slidably mounted to the elevating support member, and is engaged to a pinion which is also mounted to the elevating support member. The rotation of the pinion drives the rack, which translates the rotating movement into a pivoting of the bed support member thereby causing a desired tilt of the casket bed frame. This pivoting is achieved by the interaction of a slot in the bed support member and an arm on the rack. The pinion which moves the rack is rotated by a second shaft. The second shaft engages the pinion only to rotate it but the pinion freely slides vertically on the second shaft.

8 Claims, 16 Drawing Figures

COFFIN BED ADJUSTING APPARATUS

BACKGROUND OF THE INVENTION

1. Field of the Invention

This invention relates in general to an apparatus for adjusting coffin beds, and more particularly, to an apparatus for adjusting both the vertical height and the tilt of a bed in a burial casket.

2. Description of the Prior Art

It is desirable to be able to adjust the vertical height and the tilt of a coffin bed within a casket. These adjustments are utilized so that the deceased may be appropriately viewed during memorial services. In the past, devices for so adjusting the height and tilt of coffin beds generally have not been of simple construction and have either been cumbersome to use or of complicated and expensive construction.

The following is a list of U.S. Patents which disclose various adjustable coffin beds. These patents disclose a wide variety of coffin bed adjusting mechanisms.

| U.S. Pat. No. | Patentee |
|---|---|
| 289,643 | Goff |
| 1,800,793 | Harms |
| 1,934,425 | Harms |
| 2,051,163 | Corrigan |
| 2,159,144 | Fletcher |
| 2,729,875 | White |
| 2,848,781 | Slaughter et al. |
| 2,888,732 | Nelson |
| 3,065,516 | Dower |
| 3,192,596 | Gruber |
| 3,300,828 | Hegman et al. |
| 3,300,829 | Hegman et al. |
| 3,539,142 | Morand |
| 3,568,275 | Carson |
| 3,653,104 | Nelson |
| 2,670,517 | Hillenbrand et al. |
| 2,839,814 | Harter |

U.S. Pat. No. 289,643 to Goff discloses a device using notch standards to raise and lower the bed. The use of notches as in Goff and in other patents tends to make manipulation and adjustment of the bed cumbersome since the entire bed is moved by hand and not by the use of a mechanism. U.S. Pat. No. 1,800,793 to Harms discloses a device which uses a complicated hinged levering mechanism centrally located beneath the bed, and requires a number of complicated parts and materials. U.S. Pat. No. 1,934,425 to Harms discloses another notch and lever tilting device which requires several parts and a curved notched member. U.S. Pat. No. 2,051,163 to Corrigan discloses yet another complicated notch and bar elevating mechanism. U.S. Pat. No. 2,159,144 to Fletcher discloses a large mechanism which tilts an entire casket. U.S. Pat. No. 2,729,875 to White discloses a device which uses a horizontal rod and a column of apertures, and is similar in use to the notch devices. Slaughter et al. discloses a device which requires the actual tilting of the bed itself upon a pivoting point after a nut and screw which maintains the tilt is loosened. This device must be tilted by hand and requires reaching into the coffin to get at the screw to loosen it. U.S. Pat. No. 2,888,732 to Nelson discloses a complex mechanical device using several lever arms with pivoting points. U.S. Pat. Nos. 3,192,596 to Gruber, 3,300,828 to Hegman et al., and 3,568,275 to Carson also disclose the use of notched members to adjust the height of the bed.

U.S. Pat. No. 3,065,516 to Dower discloses a tilting apparatus using springs and a number of complicated tilting mechanisms. Various angles are achieved by rotating a number of threaded shafts through a number of elevation members which have bed support members pivotally mounted to them. The apparatus disclosed requires a complicated device and a number of mechanisms to achieve tilting and height adjustment. The disclosed device shows the use of five separate mechanisms to adjust the tilt and elevation of the bed.

U.S. Pat. No. 3,539,142 to Morand discloses a device which adjusts the vertical position of the coffin bed and maintains the height adjustment with a spring release mechanism. The mechanism does not provide for tilting the coffin bed on an axis that runs the length of the coffin.

U.S. Pat. No. 3,653,104 to Nelson discloses a device which uses a housing and a bed support member which is pivotally mounted to the housing. The bed support member is tilted by a connection to a first shaft travels vertically up to pivot a bed support member. U.S. Pat. No. 2,670,517 to Hillenbrand et al. discloses a device which has a pair of plates pivotally mounted to each other. One plate is connected to the coffin bed and has a curved gear at one end. A worm gear drives the curved gear so that the coffin bed plate pivots on the other plate. U.S. Pat. No. 2,839,814 to Harter discloses the basic twin plate idea of Hillenbrand et al. 2,670,517 but obtains the pivoting of the bed supporting plate by the use of a push rod rather than a worm gear and a curved plate gear. The user has to reach to tighten a nut so as to keep the bed tilted.

SUMMARY OF THE INVENTION

The present invention relates to a new an unique apparatus for elevating and tilting a bed in a burial casket. In one embodiment, a bed support member is pivotally mounted to an elevating support member that is adjustable in vertical height by elevation adjustment means. A rack is slidably mounted to the elevating support member, and is engaged to a pinion which is also mounted to the elevating support member. The rotation of the pinion is translated to a bed support member thereby causing a desired tilt of the casket bed frame.

DESCRIPTION OF THE PREFERRED EMBODIMENT

Figure 1:
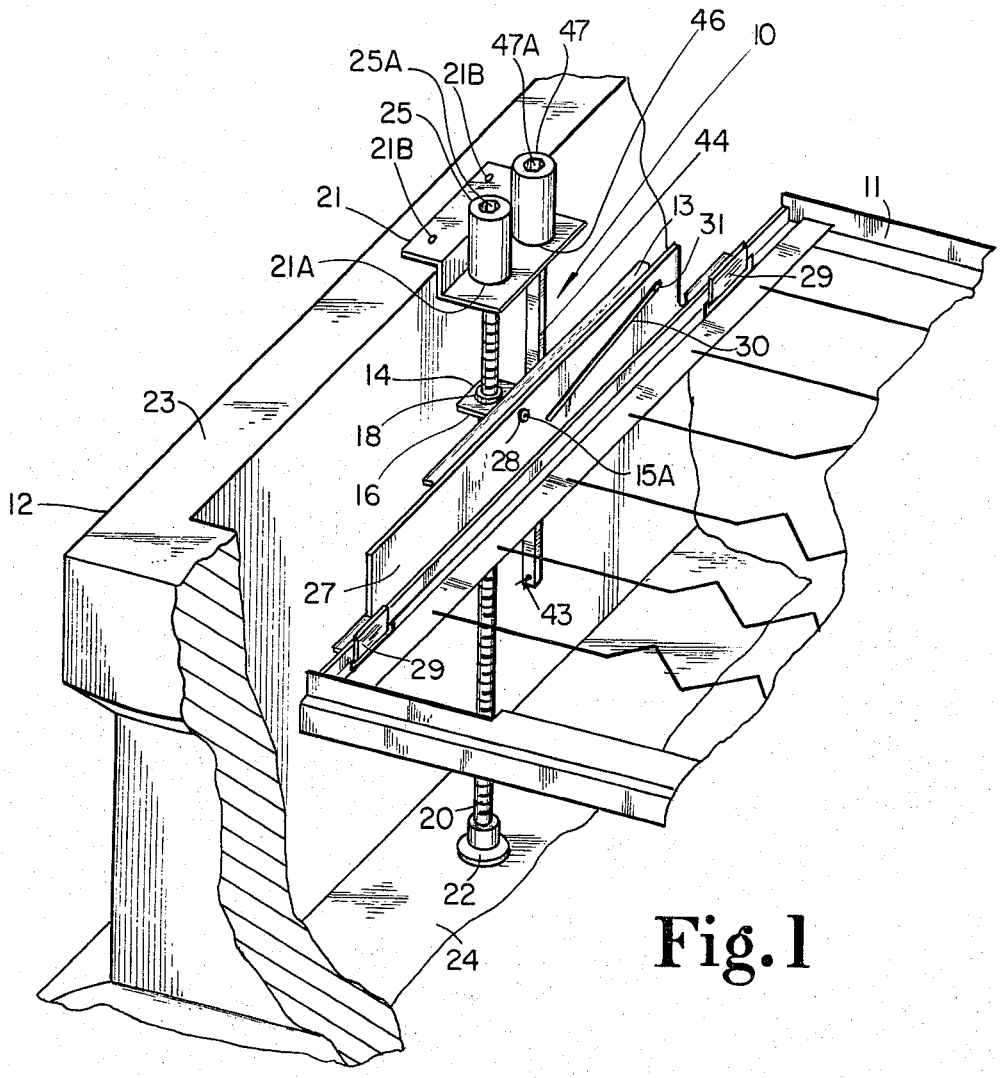
FIG. 1 is a perspective, fragmentary view of a preferred embodiment of the coffin bed adjusting apparatus mounted to a burial casket for tilting the bed mounted in the casket.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is shown an elevating and tilting apparatus 10 for altering the vertical height and the side to side tilt of a bed frame 11 which is contained in a burial casket 12. This elevating and tilting apparatus allows the user to adjust the vertical height and the side to side tilt of the bed frame to facilitate the viewing of the deceased during the funeral ceremony.

Figure 2:
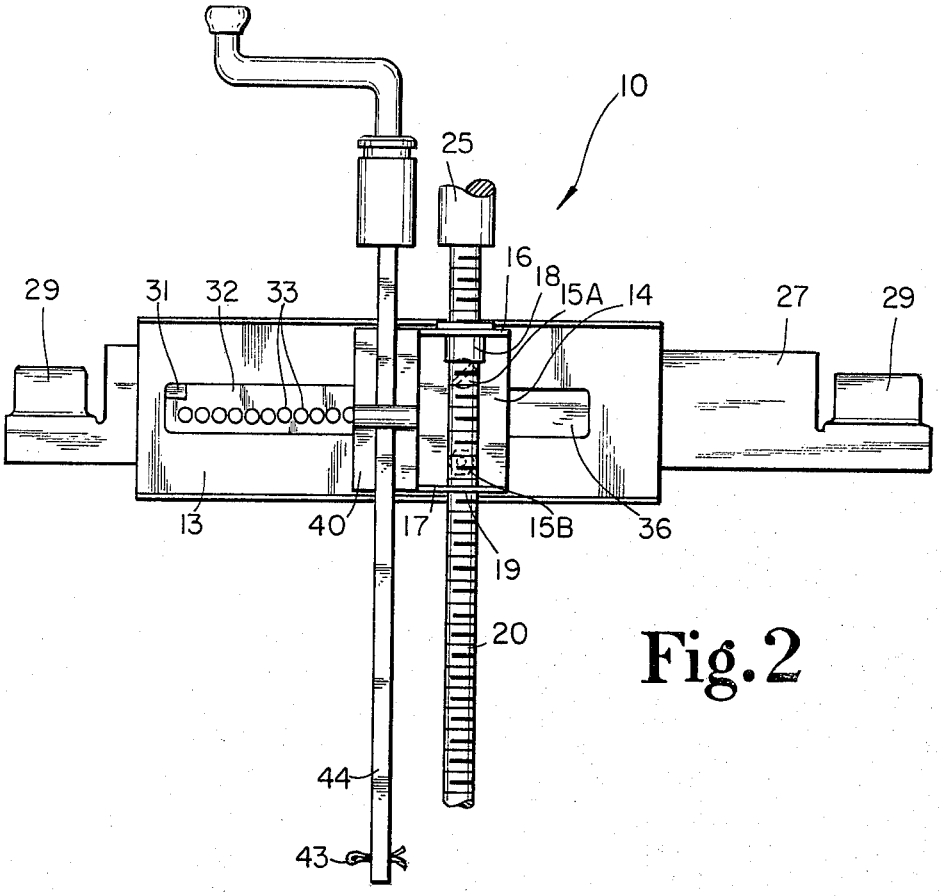
FIG. 2 is a front elevational view of a coffin bed adjusting apparatus.

Referring to FIG. 2, elevating support member 13 is connected to U-shaped bracket 14 by bolts 15A and 15B which pass through the respective holes 15C and 15D in elevating support member 13 and through holes 15E and 15F of U-shaped bracket 14. Bracket 14 has a top bracket flange 16 and a bottom bracket flange 17. Top bracket flange 16 defines an internally threaded channel 18. Bottom bracket flange 17 defines threaded bracket channel 19 which is coaxial with threaded bracket channel 18.

Figure 15:
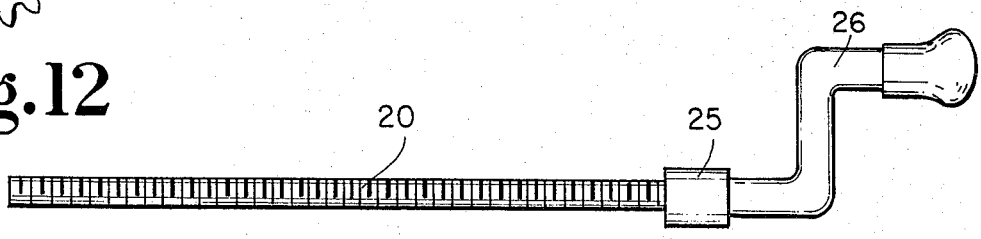
FIG. 15 is a front elevational view of the elevation means screw shaft and hand crank.

Vertical rod 20 is threadably received by bracket channels 18 and 19 as is shown in FIG. 2. Vertical rod 20 is freely rotationally mounted within bracket 21 and receiving member 22 as is shown in FIG. 1, so that the rod will freely rotate within a channel 21A in bracket 21 and within receiving member 22. Bracket 21 is mounted to the top side of the burial casket 23 by suitable means such as screws 21B. Receiving member 22 is mounted to the bottom of the burial casket 24. As is shown in FIG. 1, the top of vertical rod 20 has a hand crank receiving member 25. In the preferred embodiment, receiving member 25 has a polygonally-shaped depression 25A to receive hand crank 26 (shown in FIG. 15) The rotation of vertical rod 20 causes bracket 14 to be displaced either upward or downward, depending upon the direction of the rotation of rod 20, because of the action of the threads of rod 20 with the internal threads of bracket channels 18 and 19.

Bed support member 27 is pivotally mounted to elevating support member 13 by bolt 15A through the hole 28 in bed support member 27 and hole 15C in the elevating support member 13 and hole 15E in bracket 14. The bed frame 11 rests in bed frame arms 29 of bed support member 27. Consequently, when the vertical height of bed support member 27 is adjusted, bed frame 11 is also altered in vertical height. In this fashion, the entire elevating support member and the rest of the apparatus can be altered in vertical height by the turning of a hand crank 26 thus resulting in the altering of vertical height of the bed frame and the bed within the casket as is shown in FIG. 1.

Figure 4:
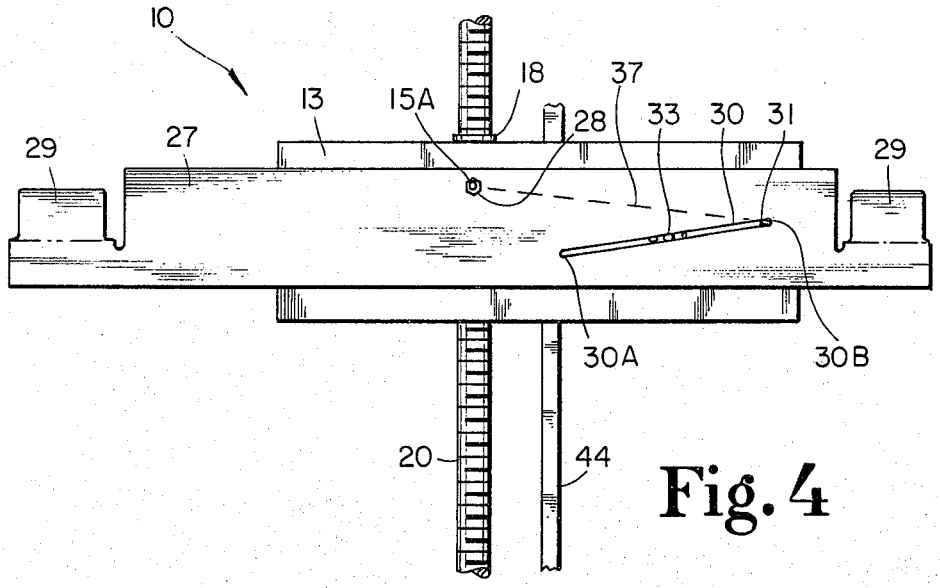
FIG. 4 is a back elevational view of a coffin bed adjusting apparatus showing the bed support member in a horizontal position.
Figure 5:
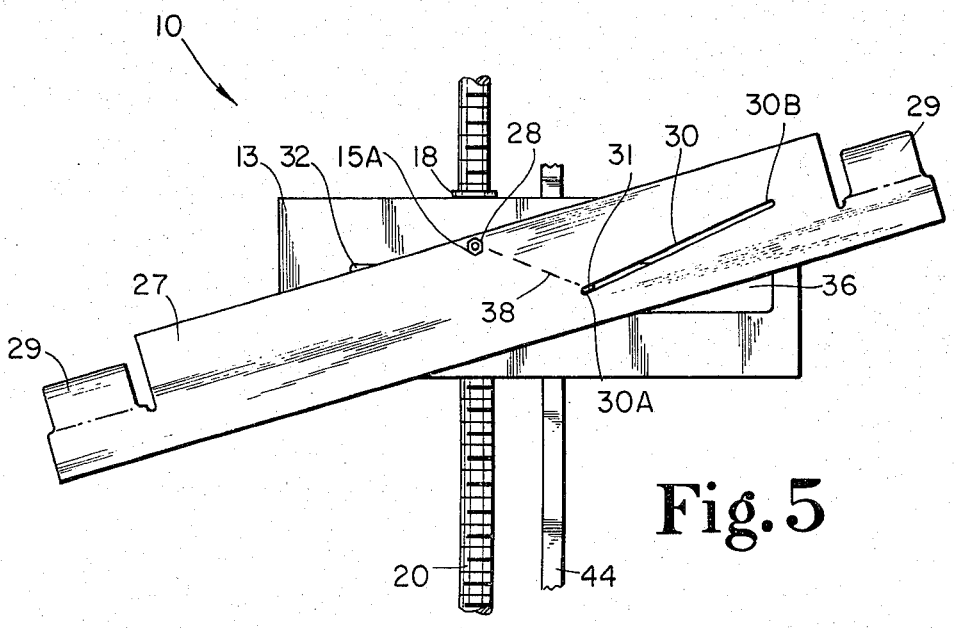
FIG. 5 is a back elevational view of a coffin bed adjusting apparatus showing the bed support member in a tilted position.
Figure 6:
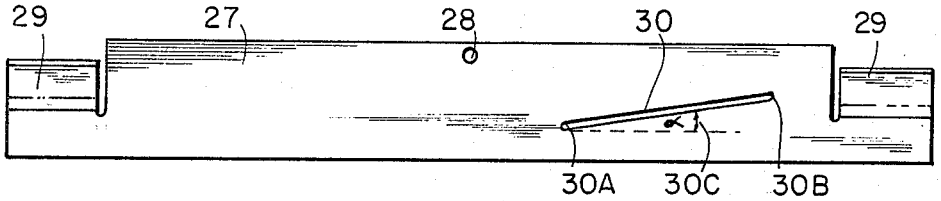
FIG. 6 is a front elevational view of the bed support member of the preferred embodiment.
Figure 6A:
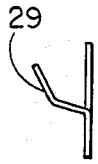
FIG. 6A is a side elevational view of the bed support member of FIG. 6.

Bed support member 27 is pivotally mounted to elevating support member 13 at point 28. Thus, bed support member 27 can be tilted to cause side-to-side tilting of bed frame 11. This side-to-side tilt of bed support member 27 is caused by a motion translation means, the preferred embodiment for which will now be described. Slot 30 in bed support member 27 has a first slot end 30A and an opposite slot end 30B as is shown in FIG. 6. Slot 30 has an angle from the horizontal from end 30A to end 30B of alpha which is shown as 30C. Arm 31 is received within slot 30, and the shifting of arm 31 along slot 30 causes bed support member 27 to pivot about point 28. Arm 31 is as shown from FIGS. 10 and 11 on a rack member 32. Rack 32 having pinion holes 33. Rack 32 is maintained in a fixed vertical position and its horizontal position is altered, causing arm 31 to slide within slot 30 from slot end 30A toward slot end 30B causing bed support member 27 to pivot about pivot point 28, as is shown in FIGS. 4 and 5. In FIG. 4, arm 31 is at slot end 30B and the bed support member 27 is in a horizontal position. In FIG. 5, arm 31 is at slot end 30A and bed support member 27 is fully tilted.

Figure 7:
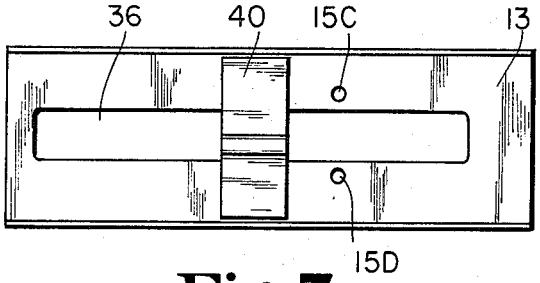
FIG. 7 is a front elevational view of the elevating support member of the preferred embodiment.
Figure 10:
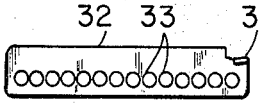
FIG. 10 is a side elevational view of the rack of the preferred embodiment.
Figure 11:
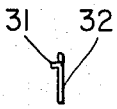
FIG. 11 is a side elevational view of the rack of FIG. 10.
Figure 13:
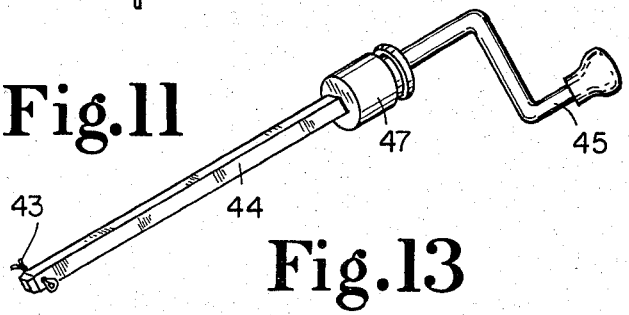
FIG. 13 is a perspective view of the pinion driving rod and hand crank of the preferred embodiment.

As is shown in FIG. 10, arm 31 is connected to rack 32 which slidably fits within a rack slot 36 (FIG. 7) in elevating support member 13. Slot 36 is long enough so that the rack can slide from one end of the slot 36 to the other end of the slot 36 so that the arm 31 of the rack will appropriately slide from one end of the slot 30A to the other end 30B of slot 30. It is the action of arm 31 upon slot 30 which causes bed support member 13 to pivot. It should be noted that the length of leverage distance 37 from the pivot point 28 to the engagement of arm 31 with slot 30 provides substantial mechanical advantage, thereby facilitating the tilting of bed frame 11 while it is laiden with a corpse. This leverage decreases as the angle of tilt increases, (see leverage distance 38 in FIG. 5) and as the useful benefit of the advantage also diminishes. By suitably selecting angle alpha 30C from the horizontal, particular desired mechanical advantage over a range of tilt may be determined for any specific apparatus.

Figure 3:
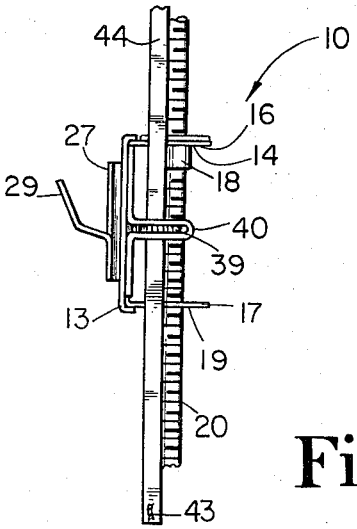
FIG. 3 is a side elevational view of a coffin bed adjusting apparatus.
Figure 8:
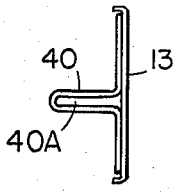
FIG. 8 is a side elevational view of the elevating support member of FIG. 7.
Figure 9:
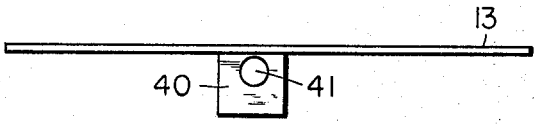
FIG. 9 is a top elevational view of the elevating support member of FIG. 7.
Figure 14:
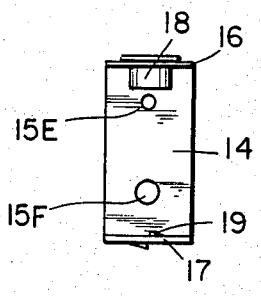
FIG. 14 is a front elevational view of the elevation means bracket.
Figure 12:
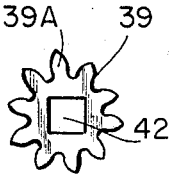
FIG. 12 is a top elevational view of the pinion used of preferred embodiment.

As pointed out, rack 32 slides within rack slot 36. This sliding is caused by the action of pinion 39 which is shown in FIG. 12 and which has gear teeth 39A that mesh with rack holes 33. Pinion 39 is disposed in a horizontal plane as shown in FIG. 3 so that when it rotates it engages rack 32 and slides rack 32 back and forth, depending upon the direction of rotation, within slot 36. This configuration enhances stability at any particular tilt position. As can be seen in FIG. 3, pinion 39 is locaterd within pinion housing 40 which is connected to elevating support member 13 As is shown in FIGS. 3 and 8, pinion housing 40 receives pinion 39 within pinion gap 40A. Pinion housing 40 has a channl 41 which is coaxial with pinion channel 42. As can be seen from FIGS. 2 and 3, when rack 32 is in rack slot 36 it cannot move in the vertical direction because of elevating support member 13 and does not come out of rack slot 36 even though elevating support member 13 is a thin piece of metal because it is held there on one side by the action of bed support member 27 and on the other side by pinion 39 and pinion housing member 40.

Pinion 37 is rotated by rotating pinion rod 44, which has a square cross-section and fits through pinion channel 42. The engagement of pinion rod 44 and pinion 39 is such that when the pinion's vertical height is altered because elevating support member's (13) vertical height is altered, pinion 39 slides vertically on rod 44 and pin 43 keeps rod 44 from being pulled out. But when rod 44 is turned by hand crank 45, pinion 37 is caused to rotate, thus moving rack 32 within slot 36. The sliding action of rack 32 causes arm 31 to move within slot 30 which in turn causes the pivoting of bed support member 37 about its pivot point 28, resulting in the tilting of bed frame 11. Finally, pinion rod 44 goes through pinion rod channel 46 in bracket 21 which is mounted to casket 12 as is shown in FIG. 1. Pinion rod 44 also includes hand crank receiving member 47 which has a polygonal depression 47A to receive hand crank 45.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention and desired to be protected.

I claim:

1. An apparatus for elevating and tilting a bed in a burial casket, said apparatus comprising:

(a) an elevating support member;

(b) elevation adjustment means for adjusting the vertical height of said elevating support member;

(c) a bed support member pivotally mounted to said elevating support member at a pivoting point, said bed support member including an elongated slot which has a first slot end and a second opposite slot end and said first slot end being closer to said pivoting point than said second opposite slot end;

(d) tilting means mounted to said elevating support member, said tilting means including an arm which is slidably received in said elongated slot so that the sliding of the arm causes contact with the walls of the slot resulting in pivoting of the bed support member about its pivoting point.

2. The apparatus of claim 1 in which said tilting means includes (1) a rack which is connected to said arm, said rack being slidably mounted to said elevating support member;

(2) a pinion drivingly engaged with said rack; and (3) pinion rotating means engaged with said pinion and operable to rotate said pinion.

3. The apparatus of claim 2 in which said elevation adjustment means includes (1) a bracket in fixed relation with said elevating support member, said bracket including an internally threaded channel; and (2) a threaded rod vertically mounted to the casket in free rotation, said threaded rod being threadedly engaged with said internally threaded channel of said bracket, for rotation of said rod vertically adjusting the position of said bracket along said threaded rod.

4. The apparatus of claim 1 in which said slot is inclined from the horizontal to the vertical at a slot angle.

5. An apparatus for elevating and tilting a bed in a burial casket, said apparatus comprising:

(a) an elevating support member;

(b) elevation adjustment means for adjusting the vertical height of said elevating support member;

(c) a rack slidably mounted to said elevating support member;

(d) a pinion mounted to said elevating support member and drivingly engaged with said rack;

(e) pinion rotating means for rotating said pinion;

(f) a bed support member pivotally mounted to said elevating support member; and (g) motion translation means for translating the sliding motion of the rack to pivoting movement of the bed support member.

6. The apparatus of claim 5 in which said pinion has a pinion rod channel disposed about the central rotational axis of said pinion, and said pinion rotating means includes a pinion rod, said pinion rod being slidably received in said pinion and rod channel and drivingly engaging said pinion in a plane perpendicular to said central rotational axis.

7. The apparatus of claim 6 in which said elevation adjustment means includes (1) a bracket in fixed relation with said elevating support member, said bracket including an internally threaded channel; and (2) a threaded rod vertically mounted to the casket in free rotation, said threaded rod being threadedly engaged with said internally threaded channel of said bracket, the rotation of said rod vertically adjusting the position of said bracket along said threaded rod.

8. The apparatus of claim 6 in which said pinion rod channel has a polygonal shape in said plane; and said pinion rod has a polygonal shaped rod.

* * * * *